US005154054A

United States Patent [19]

Nakane et al.

[11] Patent Number: 5,154,054

[45] Date of Patent: Oct. 13, 1992

[54] APPARATUS FOR DETECTING DETERIORATION OF OXYGEN SENSOR

[75] Inventors: Hiroaki Nakane, Anjo; Noriaki Kurita, Nagoya, both of Japan

[73] Assignee: Nippondenso Co., Ltd., Kariya, Japan

[21] Appl. No.: 735,024

[22] Filed: Jul. 24, 1991

[30] Foreign Application Priority Data

Jul. 24, 1990 [JP] Japan ..... 2-193803
Jul. 23, 1991 [JP] Japan ..... 3-182566

[51] Int. Cl.[5] ..... F01N 3/20
[52] U.S. Cl. ..... 60/276; 60/277
[58] Field of Search ..... 60/276, 277

[56] References Cited

U.S. PATENT DOCUMENTS 4,177,787 12/1979 Hattori ..... 60/277
4,747,265 5/1988 Nagai et al. .

FOREIGN PATENT DOCUMENTS 53-81824 7/1978 Japan .

*Primary Examiner*—Douglas Hart
*Attorney, Agent, or Firm*—Cushman, Darby & Cushman

[57] ABSTRACT

According to the present invention, in a system wherein $O_2$ sensors are disposed on upstream and downstream sides, respectively, of a catalytic converter, and an air-fuel ratio coefficient for the amount of fuel to be injected is determined on the basis of an output of the upstream-side $O_2$ sensor, the deterioration of the upstream-side $O_2$ sensor. More particularly, a delay is added to the output of the upstream-side $O_2$ sensor in accordance with an output signal provided from the downstream-side $O_2$ sensor, then an air-fuel ratio F/B control is performed in accordance with the delayed output, and when the F/B control period has become longer than a predetermined value, it is judged that the upstream-side $O_2$ is deteriorated. As a result, not only the deterioration of response characteristic but also the deterioration caused by the Z characteristic center can be detected because it appears as a change of the F/B control period.

8 Claims, 9 Drawing Sheets 1
301
NO
YES
302
303
V2 ≤ VR2
304
CDLY 2 ← CDLY2-1
305
CDLY2 < TDR2 ?
306
CDLY2 ← TDR2
307
CDLY 2 ← CDLY2+1
308
CDLY2 > TDR2 ?
309
CDLY2 ← TDL2
310
CDLY2 ≤ 0
(RICH)
(LEAN)
501
XTD ?
502
TDL1 ← TDL1 − 1
503
TDL1 < TL1
504
TDL1 ← TL1
505
XTD = 1
506
TDR1 ← TDR1 − 1
507
TDR1 < TR1
508
TDR1 ← TR1
511
XTD ?
512
TDR1 ← TDR1 + 1
513
TR1 > TR2
514
TDR1 ← TR2
515
XTD = 0
516
TDL1 = TDL1 + 1
517
TDL1 > TL2
518
TDL1 ← TL2
323

APPARATUS FOR DETECTING DETERIORATION OF OXYGEN SENSOR

BACKGROUND OF THE INVENTION

1. Industrial Utilization Field

The present invention relates to an apparatus for detecting the deterioration of an oxygen sensor which is disposed in an exhaust system of an internal combustion engine in an air-fuel ratio controller of the engine and which outputs signals according to oxygen concentrations in exhaust gases.

2. Prior Art

Recently, as means for diminishing harmful exhaust gases from vehicles and improving fuel economy and drivability, there has been proposed a feedback type air-fuel ratio controller which controls the air-fuel ratio on the basis of information on exhaust gas components from an internal combustion engine such as a vehicular engine.

In the air-fuel ratio controller of the type just mentioned above, in the event of trouble of an exhaust gas sensor for detecting the concentration of an exhaust gas component or of any other portion, there is not performed a normal control and it is likely that the air-fuel mixture will become overrich or overlean with respect to an appropriate value. Once the air-fuel mixture becomes lean, the operating characteristic and stability of the engine are deteriorated, and an overrich condition of the mixture gives rise to problems such as, for example, an increase in the proportion of harmful components contained in exhaust gases. Therefore it is necessary to promptly detect an abnormal condition of the air-fuel ratio controller and take appropriate measures.

In such air-fuel ratio controlling method, an abnormal condition of a component in exhaust gases or troubles in the control system occur in the case where a proper control cannot be made due to, for example, failure or deterioration of a sensor used, e.g. oxygen sensor (hereinafter referred to simply as "$O_2$ sensor"), itself. Particularly, since the $O_2$ sensor is in many cases disposed near an engines, it is directly influenced by high temperature and pressure and vibrations, so is apt to be deteriorated. On the other hand, since the $O_2$ sensor detects exhaust gases just after discharge from the engine, the composition of components is extremely unstable and thus the sensor is apt to be influenced by the cycle of the engine, so it is desired for the $O_2$ sensor to always have an extremely high detection accuracy.

Therefore, when the detection accuracy of the $O_2$ sensor is deteriorated for some reason or other, it is necessary to immediately detect this condition, clear up the cause and take appropriate measures, for example, replacement of the sensor with a new one. However, means capable of detecting a deteriorated state of the $O_2$ sensor easily and exactly has heretofore been not available.

As a method for detecting the deterioration of the $O_2$ sensor there is known the method disclosed in Japanese Patent Laid Open No. 81824/78. According to this method, an $O_2$ sensor is disposed between an exhaust port of an engine and a catalytic converter, and when the frequency of air-fuel ratio feedback (F/B) carried out using an output of the $O_2$ sensor has become lower than a predetermined value, it is judged that the sensor is deteriorated, by utilizing the phenomenon that said F/B frequency becomes lower with deterioration of response characteristic.

However, there are two kinds of deterioration patterns of the $O_2$ sensor, in one of which the rising of Z characteristic of the sensor deviates from a theoretical air-fuel ratio, that is, the air-fuel ratio control center deviates, as shown in FIG. 10(*a*), while in the other pattern, the response characteristic of the $O_2$ sensor is deteriorated, as shown in FIG. 10(*b*). In the type (a) deterioration, the F/B frequency itself is almost the same as in the normal state. On the other hand, once the type (b) deterioration occurs, the detection itself of rich/lean reversal is delayed and the air-fuel ratio is controlled in the reverse direction after actual occurrence of an overrich or overlean condition, thus resulting in that the F/B period becomes very long, that is, the frequency becomes smaller.

According to the above prior art, since the deterioration of an $O_2$ sensor is detected on the basis of frequency, it is impossible to detect the (a) type deterioration although the (b) type deterioration can be detected. However, since an actual deterioration of emission occurs in a combination of the foregoing two patterns of deteriorations, it is necessary to detect both (a) and (b) types of deteriorations accurately at a time.

SUMMARY OF THE INVENTION

It is the object of the present invention to remedy the above-mentioned drawbacks of the prior art and provide an apparatus capable of detecting a deteriorated state of an $O_2$ sensor efficiently and economically, whereby it is intended to improve fuel economy and drivability while making control for the components of exhaust gases.

According to the present invention, taking note of the fact that a downstream-side $O_2$ sensor is difficult to be deteriorated because it is located behind a catalytic converter, the delay time in F/B control of an upstream-side $O_2$ sensor is adjusted in accordance with a rich/lean signal provided from the downstream-side $O_2$ sensor and thereafter the F/B frequency of the upstream-side $O_2$ sensor is measured, then on the basis of this measured frequency there is made a judgment as to whether the upstream-side $O_2$ sensor is deteriorated or not.

Consequently, as shown in FIG. 10(*a*), a delay time is added to the start of F/B of the front $O_2$ sensor by F/B of the downstream-side $O_2$ sensor even in the event of deviation of Z characteristic, and hence the frequency is modulated, resulting in that the deterioration of FIG. 10(*a*) type also appears as a change of frequency and so it becomes possible to detect deterioration on the basis of a frequency value.

The relation between F/B control frequency of the upstream-side $O_2$ sensor and emission is as shown in FIG. 11. As shown in the same figure, when the frequency becomes lower than a predetermined certain value, then there occurs the deterioration of emission. Therefore, this frequency may be used for judging the deterioration of the upstream-side $O_2$ sensor.

According to one aspect of the present invention, in order to achieve the above-mentioned object, there is provided an apparatus for detecting the deterioration of an $O_2$ sensor in an air-fuel ratio controller of an internal combustion engine having the following construction. In an air-fuel ratio controller of an internal combustion engine comprising a catalytic converter 5 disposed in an exhaust system 10 of the internal combustion engine 1, first and second oxygen sensors 4, 6 disposed on an upstream side and a downstream side, respectively, of the catalytic converter 5 in the exhaust system for detecting the concentration of a specific component contained in exhaust gases, and an air-fuel ratio feedback control circuit 3 which calculates an air-fuel ratio correction coefficient on the basis of output signals provided from the first and second oxygen sensors and corrects a reference amount of fuel to be fed, the apparatus for detecting the deterioration of an oxygen sensor according to the present invention comprises, in the air-fuel ratio feedback control circuit 3, a first detector means 11 for detecting whether an air-fuel ratio feedback signal indicates a rich state or a lean state on the basis of an output provided from the first oxygen sensor 4, a second detector means 12 for adding a predetermined delay time to an output of the first detector means 11 and detecting an air-fuel ratio inversion time-point in the air-fuel ratio feedback signal, a delay time adjusting means 13 for adjusting the delay time in response to an output of the second oxygen sensor 6, a first counter 14 for detecting an inversion time-point at least one of rich to lean state and lean to rich state and counting the number of times thereof occurred, a second counter 15 for counting pulses until the value on the first counter 14 reaches a predetermined value, and a third detector means 16 which judges that the first oxygen sensor is deteriorated when the value on the second counter 15 has become larger than the predetermined value, and outputs a warning signal.

In the present invention, as mentioned above, a second $O_2$ sensor is disposed downstream of the catalytic converter in the exhaust system in addition to the $O_2$ sensor (the first $O_2$ sensor) disposed upstream of the catalytic converter in the foregoing prior art, and time-point of inversion from lean to rich or from rich to lean in the air-fuel ratio fed back on the basis of the output of the first $O_2$ sensor is judged in consideration of a predetermined delay time and is counted. Then, when the number of times of such inversion has reached a predetermined value, a time factor from an initial value at that time is calculated, and if the time factor is above the predetermined value, it is judged that the $O_2$ sensor is deteriorated. In the present invention, moreover, the delay time which is set for judging an inversion timing of the air-fuel ratio feedback signal is adjusted in accordance with the output of the second $O_2$ sensor, so even in the event of deviation of the F/B control center due to deterioration of an $O_2$ sensor for example, by keeping the control center appropriate without depending on the deterioration of the upstream-side $O_2$ sensor, a deviation in characteristic from the control center of the upstream-side $O_2$ sensor can be allowed to appear as a change in F/B frequency, and thus with only F/B frequency it is made possible to detect the two deterioration patterns of the $O_2$ sensor.

DESCRIPTION OF THE PREFERRED EMBODIMENT

An apparatus for detecting the deterioration of an $O_2$ according to an embodiment of the present invention will be described in detail hereinunder with reference to the accompanying drawings.

Figure 1:
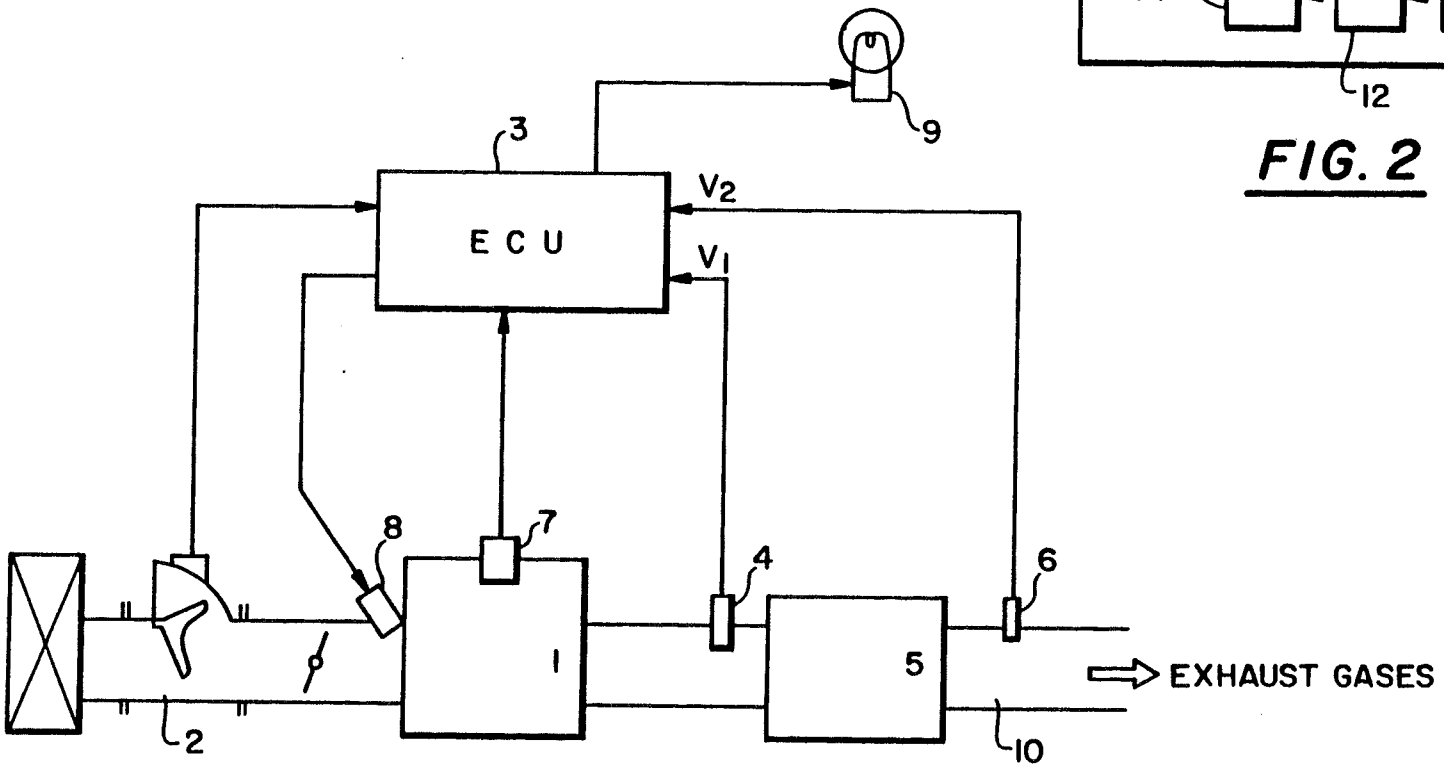
FIG. 1 is a basic construction diagram of an apparatus for detecting the deterioration of an $O_2$ sensor according to the present invention.

Referring first to FIG. 1, there is shown an example of a basic construction of the $O_2$ sensor deterioration detecting apparatus embodying the invention which is used in an air-fuel ratio controller of an internal combustion engine. In FIG. 1, an air flow meter 2 for detecting an intake quantity is disposed in an intake system of the internal combustion engine indicated at 1, and an output thereof is fed to an air-fuel ratio feedback control circuit (ECU) 3.

In an exhaust system 10 of the engine 1 there are provided an upstream-side $O_2$ sensor (a first $O_2$ sensor) 4, a catalytic converter 5 and a downstream-side $O_2$ sensor 6 successively in this order from an upstream-side of exhaust gases. Output sides of both $O_2$ sensors 4 and 6 are connected to the ECU 3. A crank angle sensor 7 is attached to the engine 1, and an output signal from the sensor 7 is fed to the ECU 3. The ECU 3 determines a fuel injection quantity on the basis of the inputs fed from those sensors and drives an injector 8 disposed in the intake system, thereby controlling the air-fuel ratio in the engine 1.

As will be described below, the ECU 3 detects the deterioration of the upstream-side $O_2$ sensor 4 on the basis of the input signals and turns on an alarm lamp 9 upon detection of the deterioration.

Figure 2:
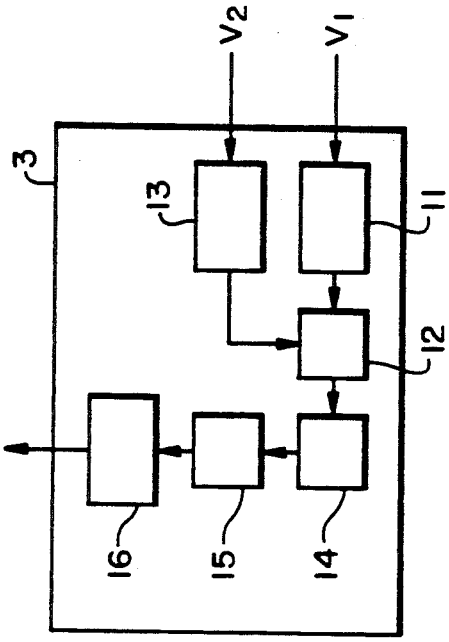
FIG. 2 is a block diagram showing a configuration example of an $O_2$ sensor deterioration detecting circuit provided in an air-fuel ratio feedback control circuit illustrated in FIG. 1.

In the air-fuel ratio feedback control circuit (ECU) 3 there is provided, for example, such an $O_2$ sensor deterioration detecting circuit according to the present invention as shown in FIG. 2. According to a basic detection circuit thereof, an output signal from the first $O_2$ sensor 4 is fed to a first detector means 11, which in turn judges whether the air-fuel ratio feedback signal indicates a rich state or a lean state and produces such an output signal as shown in waveform (A) of FIG. 3. This output signal is fed to a second detector means 12, which in turn adds a predetermined delay time TDR to the output signal provided from the first detector means and detects an inversion time-point from lean to rich state or from rich to lean state in the air-fuel ratio feedback signal, to obtain such an output signal as shown in waveform (C) of FIG. 3. In this case, with only the information from the first $O_2$ sensor 4, the value provided is a fixed value, so in the event of deviation of the center of the feedback frequency (F/B) due to a marked change in the exhaust gas concentration or due to failure or deterioration of the sensor itself, there may occur an error in the rich/lean judgment. Therefore the above delay time TDR is adjusted suitably using a delay time adjusting means 13 which inputs an output signal from the second $O_2$ sensor 6, to thereby inversion obtain an appropriate feedback frequency (F/B). Further, inversion time-points in the output of the second detector means 12 are counted by a counter 14, and when the counter value has reached a predetermined value, a time factor from an initial value up to that time is counted by a second counter 15, e.g. a suitable pulse counter, then the value obtained is compared with a predetermined value in a third detector means 16. When the third detector means 16 judges that the counted value is larger than the predetermined value, it judges that the $O_2$ sensor is deteriorated, and provides an output signal for driving an alarm means (for example, turning on the alarm lamp 9).

The $O_2$ sensor whose deterioration is to be detected by the apparatus of the present invention is mainly the first $O_2$ sensor 4. Since the second $O_2$ sensor 6 is disposed on the downstream side of the catalytic converter 5, there is no fear of its deterioration caused by the adhesion of engine oil, etc. thereto, and hence it is used mainly for providing adjustment data to absorb variations in output characteristics of the first $O_2$ sensor 4 in the case of calculating the output of the same sensor.

The following description is now provided about such a method as in the present invention wherein the $O_2$ sensors 4 and 6 are separately provided upstream and downstream respectively of the catalytic converter 5, an air-fuel ratio feedback control is made using those sensors, and the sensor deterioration is detected by the introduction of a delay time.

In the air-fuel ratio controlling method using $O_2$ sensors according to the present invention, a basic injection volume in a fuel injection valve is calculated according to an intake air volume (or an intake air pressure) in the engine and a rotating speed of the engine, then the said basic injection volume is corrected in accordance with an air-fuel ratio correction coefficient FAF which has been calculated on the basis of a detected signal provided from an $O_2$ sensor for detecting the concentration of a specific component, e.g. oxygen, contained in engine exhaust gases, and the amount of fuel to be fed actually is controlled in accordance with the corrected injection volume. This control is repeated so that the air-fuel ratio in the engine eventually falls under a predetermined range. By such an air-fuel ratio feedback control it is made possible to control the air-fuel ratio within a very narrow range close to a theoretical air-fuel ratio. In obtaining the air-fuel ratio correction coefficient FAF and making the air-fuel ratio control, there are utilized the outputs of the first and second $O_2$ sensors. In this case, the detection based on the output of the first $O_2$ sensor 4 as to whether the air-fuel ratio is on a rich side or a lean side as well as the detection of an inversion time-point between those states are effected by the introduction of a delay time obtained on the basis of the output of the second $O_2$ sensor 6, then the deterioration of the first $O_2$ sensor 4 is detected by utilizing the data obtained.

The process of the present invention referred to above will be explained below with reference to the flowchart of FIG. 4.

Figure 4:
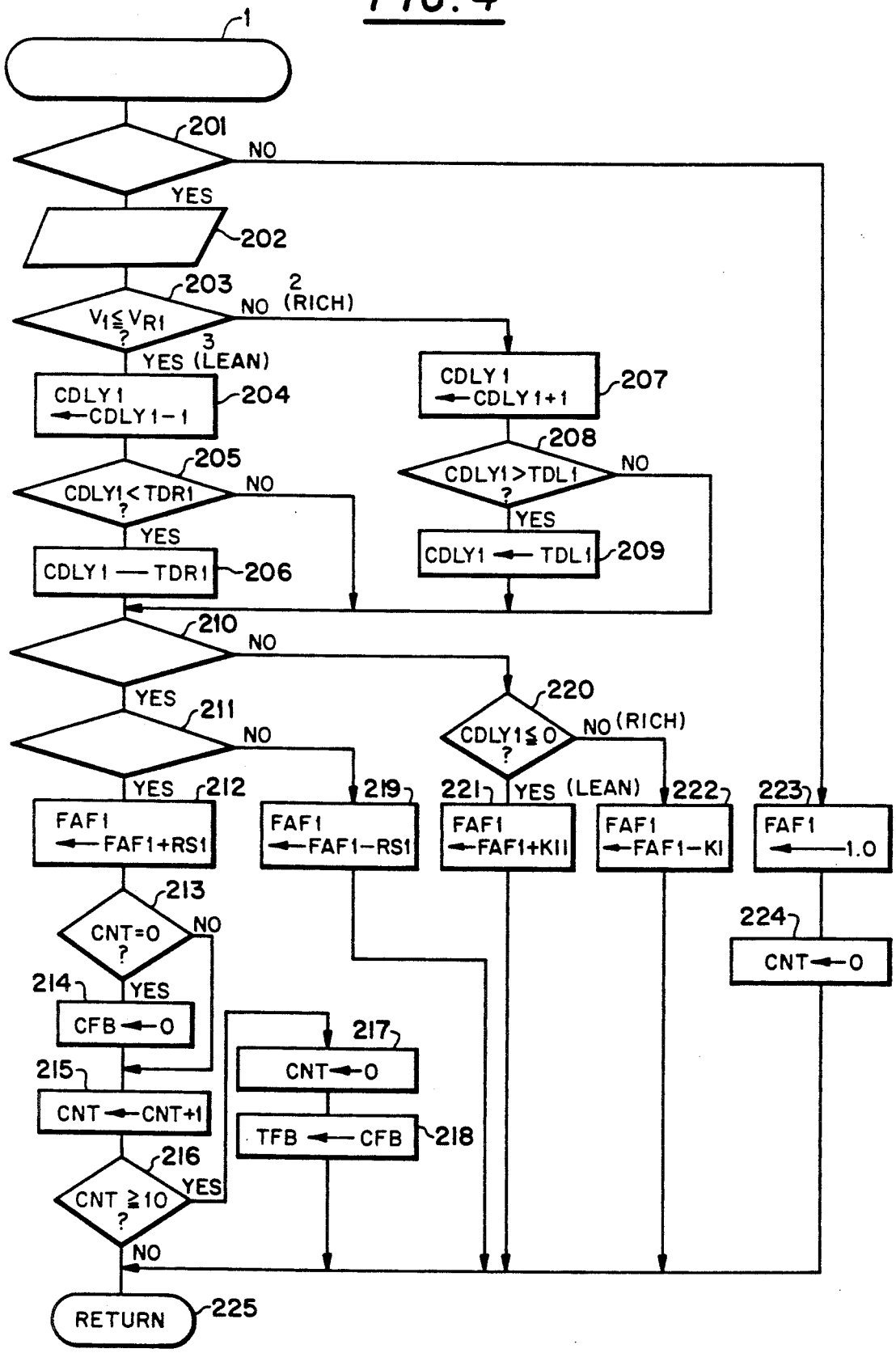
FIG. 4 is a flowchart for operating a counter which is for detecting the deterioration of a first $O_2$ sensor in the invention.

FIG. 4 illustrates an air-fuel ratio feedback control routine for calculating the air-fuel ratio correction coefficient FAF 1 on the basis of the output of the first $O_2$ sensor 4. This routine is executed at every predetermined time, say, 4 ms.

In step 201 there is made a judgement as to whether air-fuel ratio feedback conditions based on the first $O_2$ sensor 4 exist or not. During start-up of the engine, during increase of the amount of fuel after the start-up, in warming-up and for obtaining a driving power, as well as during lean control and in an inactive state of the first $O_2$ sensor 4, the feedback conditions are not established, while in other cases there are established closed loop conditions. The judgement as to whether the first $O_2$ sensor 4 is in an active state or in an inactive state is made by reading out water temperature data THW stored in a memory means such as RAM which is provided beforehand in the air-fuel ratio feedback control circuit 3 and then judging whether the condition of THW$\geqq$70° C. has once satisfied or not, or judging whether the output level of the first $O_2$ sensor has once varied or not. When the feedback conditions are not established, the processing routine proceeds to step 223, in which the air-fuel ratio correction coefficient FAF 1 is set to 1.0, then in step 224, a feedback counter CNT which will be described later is cleared and this routine is ended.

On the other hand, when the feedback conditions are not established, the processing routine advances to step 202.

In step 202, the output V1 of the first $O_2$ sensor 4 is taken in after A/D conversion, then in step 203 there is made a judgement as to whether V1 is not larger than that a comparative voltage VR, say, 0.45 V. That is, whether the air-fuel ratio is rich or lean is judged.

FIG. 3 illustrates waveforms for judging the state of air-fuel ratio. Assuming that the output V1 of the first $O_2$ sensor 4 is of the waveform (A) in FIG. 3, this waveform is compared with the comparative voltage VR1 as a reference voltage through a suitable comparison circuit, which corresponds to the first detector means in the present invention, and when the output waveform of V1 is higher than the reference voltage VR1, this state is judged to be rich in terms of air-fuel ratio, while in the reverse case it is judged that the air-fuel ratio is in a lean state. Then, a voltage of a predetermined level is outputted on the basis of such judgement. This output waveform is as shown in FIG. 3(B). In a lean state (V1$\leqq$VR1), the value of a first delay counter CDLY1 is substituted in step 204, then in steps 205 and 206 the first delay counter CDLY1 is guarded at a minimum value TDR1. The minimum value TDR1 is a rich delay time for holding a lean-state judgement even when there is a change from lean to rich in the output of the first $O_2$ sensor 4, and it is defined by a negative value.

Figure 3A:
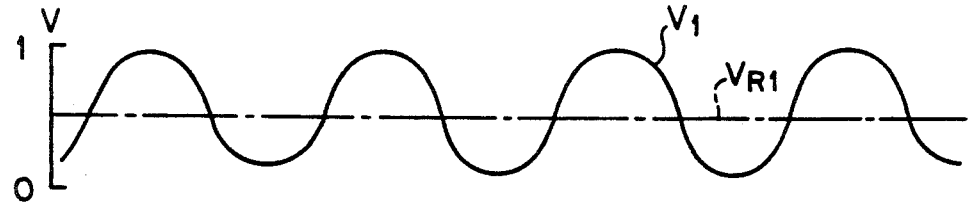
FIG. 3 illustrates output waveforms of two $O_2$ sensors and of air-fuel ratio feedback signals in an air-fuel ratio feedback control performed using the two $O_2$ sensors.
Figure 3B:
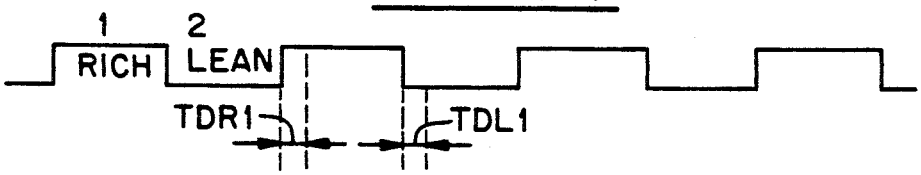
Figure 3C:
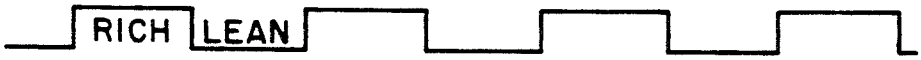
Figure 3D:
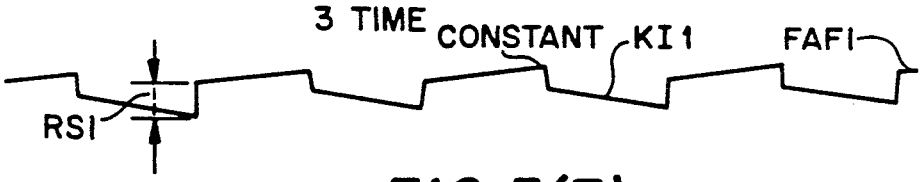
Figure 5A:
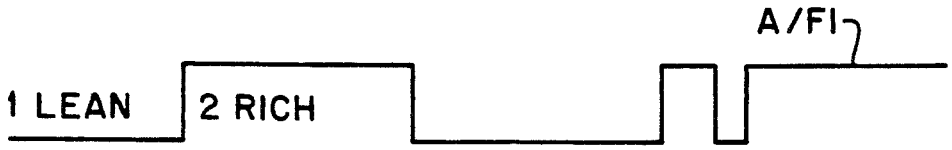
FIG. 5 illustrates waveforms formed in the case of delaying an air-fuel ratio feedback signal by introducing a delay time therein at the time of making an air-fuel ratio feedback control using $O_2$ sensor.
Figure 5B:
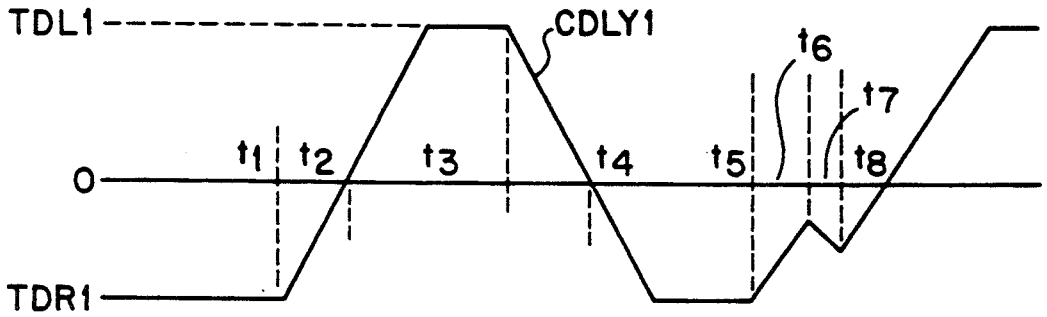
Figure 5C:
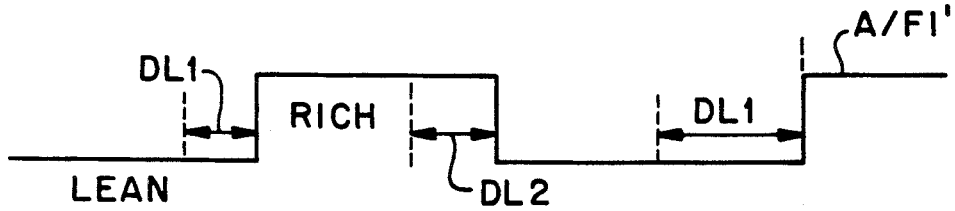

More particularly, as shown in FIG. 5, if the output of the first detector means illustrated in FIG. 3(B) corresponds to FIG. 5(A), then in the case where the air-fuel ratio changes from rich to lean state at time t3 in FIG. 5(B), a delaying means operates from time t3, as shown in FIG. 5(B), to subtract 1 at a time successively from a maximum value TDL1 of the delay counter CDLY1. This operation is repeated while the lean state is continued until the waveform of the delay counter CDLY1 descends on the right-hand side, then across a reference level 0 and reaches the minimum value TDR1 of the delay counter CDLY1. In this case, at time t4 indicating the time when the waveform of FIG. 5(B) showing the value of the delay counter CDLY1 traversed the reference level 0, there is outputted a waveform corresponding to an inversion of the waveform of FIG. 5(A) from rich to lean state. More specifically, the waveform of FIG. 5(C) is formed by delaying the waveform of FIG. 5(A) by a delay time (DL2) corresponding to the difference between times t3 and t4. This process is carried out by the second detector means in the present invention. On the other hand, if the air-fuel ratio is in a rich state (V1>VR1), a value is added to the first delay counter CDLY1 in step 207, then in steps 208 and 209 the first delay counter CDLY1 is guarded by the maximum value TDL 1. The maximum value TDL 1 indicates a lean delay time for holding a rich-state judgment even when there is a change from rich to lean in the output of the first $O_2$ sensor 4, and it is defined by a positive value.

Such process is also carried out by the second detector means in the present invention. Referring again to FIGS. 5(A) to (C), if the signal of FIG. 5(A) changes from lean to rich state at time t1 the delaying means operates from time t1 as shown in FIG. 5(B), whereby a value of 1 at a time is added successively to the minimum value TDR 1 of the delay counter CDLY 1. This operation is repeated while the rich state in the waveform of FIG. 5(A) is continued until the waveform of the delay counter CDLY1 ascends on the right-hand side, then across the reference level 0 and reaches the maximum value TDL 1 of the delay counter CDLY1. In this case, at time t indicating the time when the waveform of FIG. 5(B) showing the value of the delay counter CDLY1 traversed the reference level, there is outputted a waveform corresponding to an inversion of the waveform of FIG. 5(A) from lean to rich state. More specifically, the outputted waveform corresponds to a waveform obtained by delaying the waveform of FIG. 5(A) by a delay time (DL1).

Figure 5D:
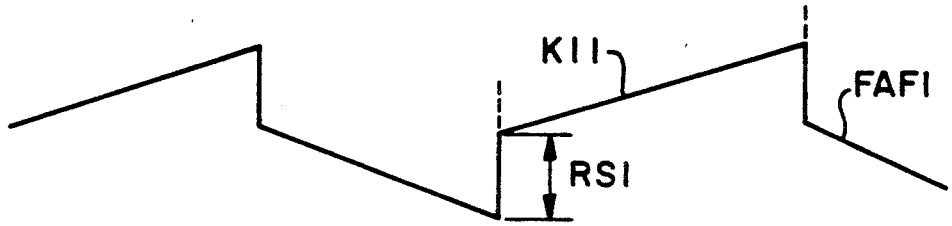

In the above process, if an air-fuel ratio signal A/F1 is inverted in a period shorter than a rich delay time (−TDR 1) as at times t5, t6 and t7, for example as shown in FIG. 5(A), by delaying the detection of a feedback state based on the air-fuel ratio signal using the delay counter, it takes time for the first delay counter CDLY1 to cross the reference value 0, resulting in that at time t8 the air-fuel ratio signal A/F1′ after the delay processing is inverted. That is the air-fuel ratio signal A/F1′ after the delay processing is stabler than the air-fuel ratio signal A/F1 before the same processing. Thus, the air-fuel ratio correction coefficient FAF 1 shown in FIG. 5(D) is obtained on the basis of the stable air-fuel ratio signal A/F1′ after the delay processing. This is advantageous.

The reference value of the first delay counter CDLY1 is 0, and it is here assumed that the air-fuel ratio after the delay processing is regarded as being rich when CDLY1>0 and lean when CDLY1≦0.

In step 210, a judgement is made as to whether the sign of the first delay counter CDLY1 has been inverted or not, that is, whether the air-fuel ratio after the delay processing has been inverted or not. If the answer is affirmative, then in step 211, a judgement is made as to whether the inversion is from rich to lean or from lean to rich.

For the judgement of such inversion direction there can be used a known method, for example a method which utilizes the waveform inclinations shown in FIG. 5(B). It goes without saying that such inversion judging process is also carried out by the second detector means in the present invention.

When it is judged that the state of the delayed air-fuel ratio has been inverted from rich to lean, a predetermined skip correction coefficient RS is added in step 212 to the air-fuel ratio correction coefficient FAF 1 used at that time-point (time t4 in FIG. 5) to obtain FAF1+RS1 as the air-fuel ratio correction coefficient.

Conversely, when it is judged in step 211 that the inversion is from lean to rich, a decrease is made skipwise like FAF1←FAF1−RS1 in step 218; that is, a step processing is performed.

If in step 210 the sign of the first delay counter CDLY1 has not been inverted, an integral processing is performed in steps 219, 221 and 222. More specifically, whether CDLY1≦0 or not is judged in step 220, and if CDLY1≦0 (lean), there is made FAF1←FAF1+KI1 in step 220, while if CDLY1>0 (rich), there is made FAF1←FAF1−KI1, in which KI1, an integral constant, is set to KI1<RS1, sufficiently small as compared with the skip constant RS1. Therefore in step 221, the amount of fuel injected is increased gradually in a lean state (CDLY1≦0), while in step 222, the amount of fuel injected is decreased gradually in a rich state (CDLY1>0).

It is assumed that the air-fuel ratio correction coefficient FAF1 calculated in steps 212, 219 221 and 222 is guarded at a minimum value of, say, 0.8 and a maximum value of, say, 1.2. In the case where the air-fuel ratio correction coefficient FAF1 has become too large or too small for some reason or other, the air-fuel ratio of the engine is controlled by the said values to prevent it from becoming overrich or overlean.

The FAF1 calculated as above is stored in the RAM and this routine is ended in step 225. Therefore the air-fuel ratio correction coefficient FAF presents such a waveform as shown in FIG. 5(D). On the other hand, as noted previously, if there is set rich delay time (−TDR 1)>lean delay time (TDL 1) the controlled air-fuel ratio can shift to the rich side. Conversely, if there is set lean delay time (TDL 1)>rich delay time (−TDR 1), the controlled air-fuel ratio can be shifted to the lean side. In other words, the air-fuel ratio can be controlled by correcting the delay times TDR 1 and TDL 1 in accordance with the output of second $O_2$ sensor 6. In the present invention, therefore, it is intended that the delay time setting in the air-fuel ratio feedback control using the first $O_2$ sensor 4 be adjusted on the basis of the output of the second $O_2$ sensor 6. More specifically, for example the reference level 0 in FIG. 5(B) is changed by utilizing the output of the second $O_2$ sensor 6.

Figure 6:
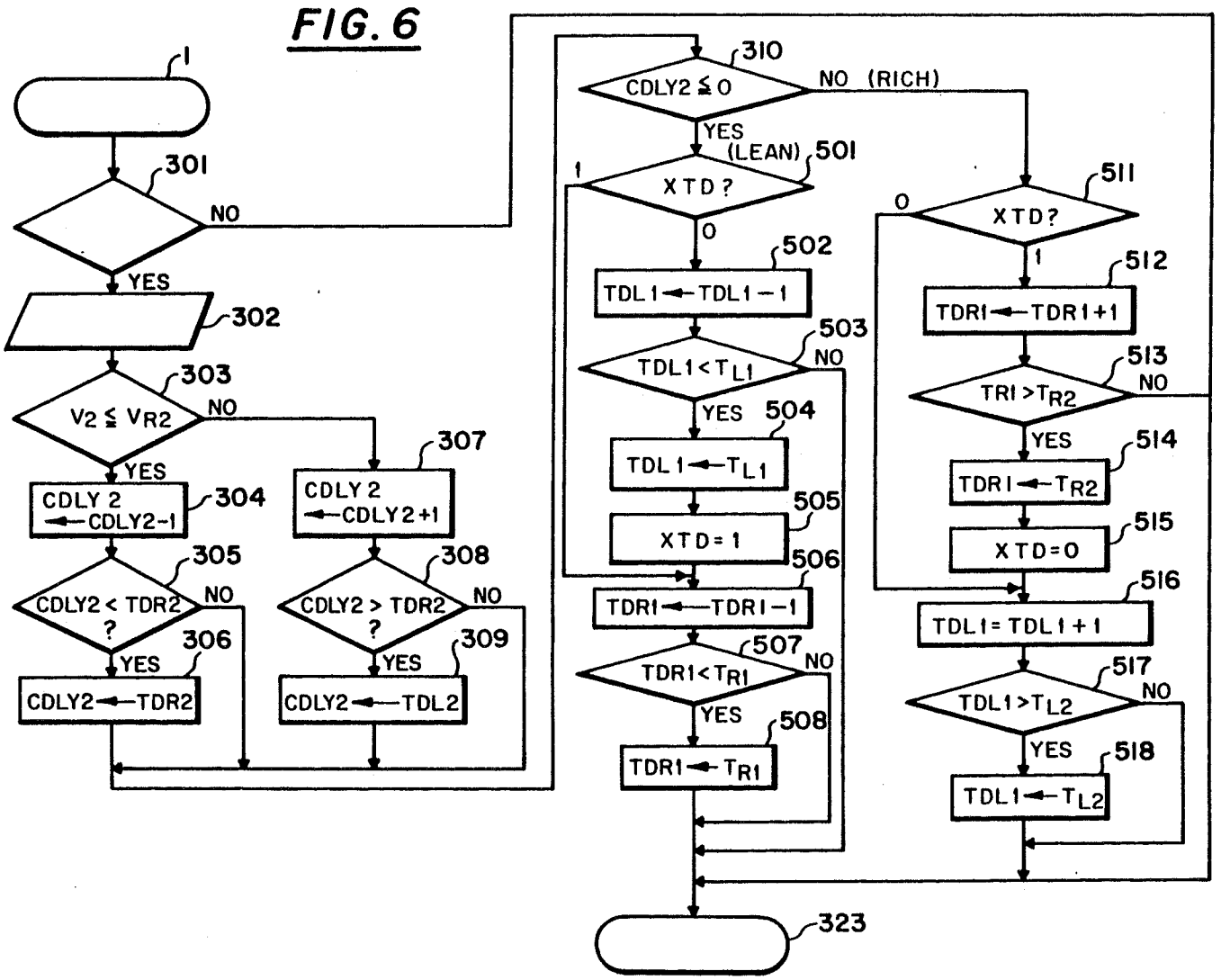
FIG. 6 is a flowchart showing an operation flow used for adjusting the delay time in the flow of detecting the deterioration of the first $O_2$ sensor using a second $O_2$ sensor.

The following description is now provided with reference to FIG. 6 about the means for adjusting the delay time in the routine of processing the output of the first $O_2$ sensor 4 using the second $O_2$ sensor 6.

FIG. 6 is a flowchart of an arithmetic processing for obtaining the delay times TDR 1 and TDL 1 using the second $O_2$ sensor 6 in the present invention. The routine illustrated in FIG. 6 is a second air-fuel ratio feedback controlling routine for calculating the delay times TDR 1 and TDL 1 on the basis of the output of the second $O_2$ sensor 6, and it is executed at every predetermined time. e.g. 1 s.

In step 301, like step 201 in FIG. 4, a judgment is made as to whether air-fuel ratio feedback conditions are established or not. If the answer is negative, this routine is ended, while if the answer is affirmative, the processing routine advances to step 302, in which an output value V2 of the second $O_2$ sensor 6 is taken in after A/D conversion. Steps 302 to 309 correspond to steps 202 to 209 in FIG. 4. That is, a rich-lean judgment is performed in step 303 and the result of the judgment is subjected to a delay processing in steps 304 to 309. Then, a rich-lean judgment after the delay processing is performed in step 310.

In step 310, a judgment is made as to whether e second delay counter CDLY2 satisfies the condition of CDLY2≦0 or not. If CDLY2≦0, the air-fuel ratio on the downstream side of the catalytic converter is judged to be lean and the processing routine proceeds to steps 501–508. On the other hand, if CDLY2>0, the air-fuel ratio on the downstream side of the catalytic converter is judged to be rich and the processing routine advances to steps 511–518.

First, in the case where the air-fuel ratio is judged to be lean, a value of flag XTD indicating which of rich delay time (TDR1) and lean delay time (TDL1) of the upstream-side $O_2$ sensor is to be varied is judged in step 501. If XTD=1 in step 501, TDR1 is changed, while if XTD=0, TDL1 is changed.

When the air-fuel ratio is lean and XTD=0 (T2 in FIG. 7), the processing routine advances to step 502, in which there is made TDL1←TDL1−1 to make adjustment for lowering the upper limit value of the delay counter CDLY1 in FIG. 5. That is, the lean delay time TDL1 in FIG. 3 is decreased to increase the speed of change from rich to lean state of the upstream-side $O_2$ sensor, thereby shifting the air-fuel ratio to the rich side. In steps 503 and 504, TDL1 is guarded at a minimum value TL1. As noted previously, since TL1 is a positive value, it means a minimum lean delay time. Then the processing routine advances to step 505, in which there is made flag XTD=1.

When it is judged in step 501 that XTD−1 (T3 in FIG. 7), the processing routine proceeds to step 506, in which the lower limit value TDR1 of the delay counter CDLY1 is lowered like TDR1←TDR1−1, the rich delay time TDR1 in FIG. 3 is increased, and the speed of change from lean to rich state of the upstream-side $O_2$ sensor is decreased, allowing the air-fuel ratio to be shifted to the rich side. In steps 507 and 508, TDR1 is guarded at a minimum value TR1. TR1 is a negative value, so (−TR1) means a maximum rich delay time.

Thus, during periods T2 and T3 in which the downstream-side $O_2$ sensor is on the lean side, a signal output of the upstream-side $O_2$ sensor is also shifted to the lean side.

On the other hand, when it is judged in step 310 that the output of the $O_2$ sensor located downstream of the catalytic converter is rich, the value of the flag XTD is detected in step 511, and when XTD=1 (T4 in FIG. 7), the processing routine advances to step 512, in which there is made TDR1←TDR1+1, that is, the lean delay time (−TDR1) is decrease to speed up the change from lean to rich state, allowing the air-fuel ratio to be shifted to the lean side. In the next steps 513 and 514, TDR1 is guarded at a maximum value TR2. Since TR2 is a also a negative value, (−TR2) means a minimum rich delay time. Then, the processing routine advances to step 505, in which there is made flag XTD=0.

When it is judged in step 511 that XTD=0 (T1 and T5 in FIG. 7), the processing routine advances to step 516, in which the lean delay time TDL1 is increased to slow down the change from rich to lean state of the upstream-side $O_2$ sensor, allowing the air-fuel ratio to be shifted to the lean side. In steps 517 and 518, TDL1 is guarded at a maximum value TL2. Since TL2 is a positive value, it means a maximum lean delay time.

Thus, in periods T1, T4 and T5 in which the downstream-side $O_2$ sensor is on the rich side, a signal output of the upstream-side $O_2$ sensor is also shifted to the rich side.

Figure 10A:
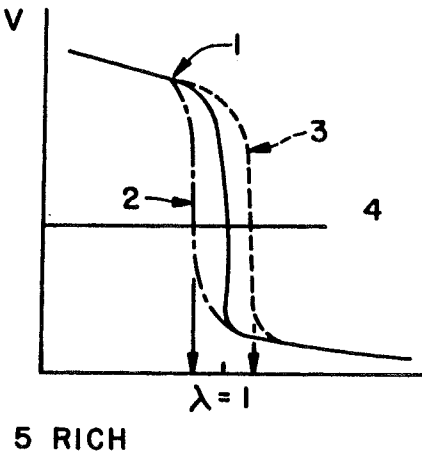
FIG. 10 is a diagram showing two deterioration patterns of an $O_2$ sensor.
Figure 10B:
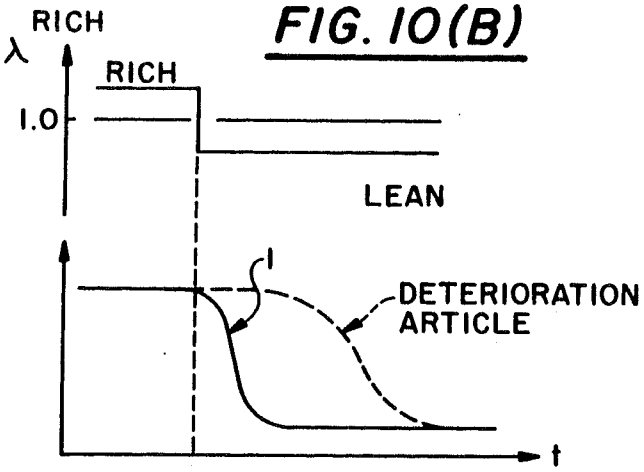
Figure 11:
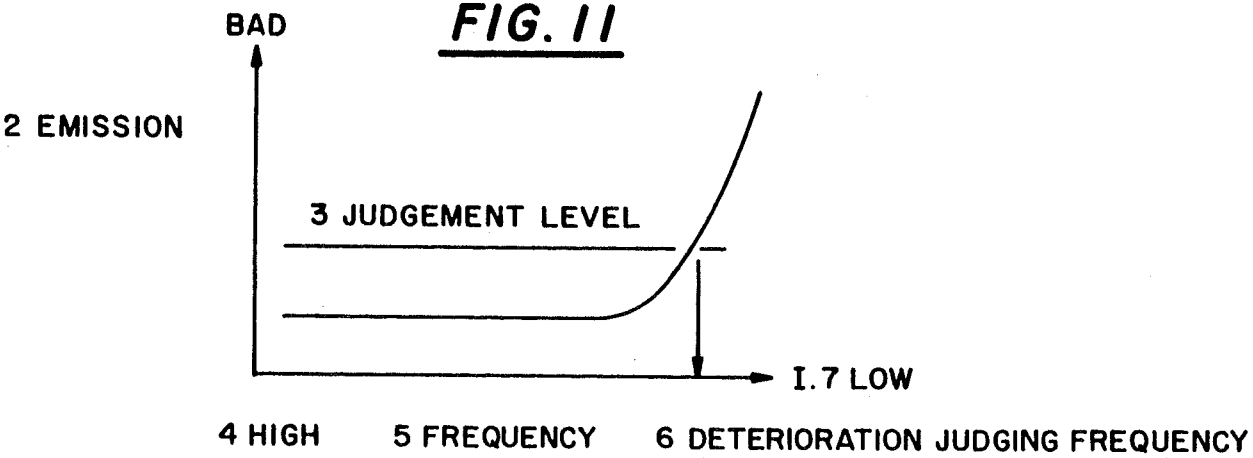
FIG. 11 is a diagram showing a relation between F/B frequency of the upstream-side $O_2$ sensor and emission components.

The processing illustrated in FIG. 6 is for conforming the inversion timing in the output of the upstream-side $O_2$ sensor to the state of a new product of the $O_2$ sensor indicated by a solid line in FIG. 10 in the case where an inverted air-fuel ratio in the output of the upstream-side $O_2$ sensor deviates from a theoretical air-fuel ratio. More particularly, for example when a lean output time of the downstream-side $O_2$ sensor is long, it is presumed that an inverted air-fuel ratio in the output of the upstream-side $O_2$ sensor is deviated to the lean side as indicated by a broken line in FIG. 10(*a*), so the inverted air-fuel ratio of the upstream-side $O_2$ sensor is corrected to the lean side forcibly by the processings of steps 501 to 508 in FIG. 6. Conversely, when a rich output time of the downstream-side $O_2$ sensor is long, it is presumed that the inverted air-fuel ratio in the output of the upstream-side $O_2$ sensor is deviated to the rich side as indicated by a dot-dash line in FIG. 10(*a*), so the said inverted air-fuel ratio is corrected to the rich side forcibly by the processings of steps 511 to 518 in FIG. 6.

In the present invention, the deterioration of the upstream-side $O_2$ sensor is judged on the basis of a signal period after such correction of the deviation in Z characteristic of the upstream-side $O_2$ sensor. Thus, since the deviation in Z characteristic is reflected in the F/B control period, it becomes possible to detect the deteriorated state of FIG. 10(*a*) which detection has heretofore been impossible.

TDR 1 and TDL 1 calculated as above are stored in the RAM and thereafter this routine is ended in step 323.

Figure 3E:
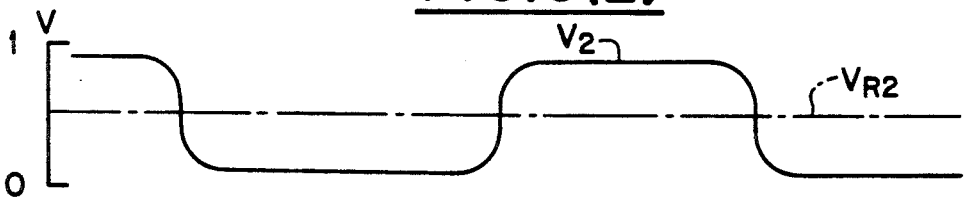
Figure 3F:
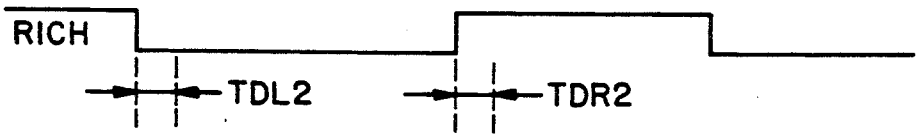
Figure 3G:
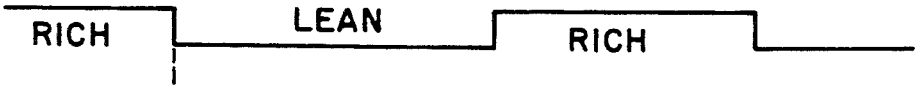

For example, the output V2 of the second $O_2$ sensor 6 in the above routine represents the waveform of FIG. 3(E) and it is compared with the reference voltage VR2, whereby there is obtained such a waveform diagram as FIG. 3(F) representing both rich and lean states, as in the case of the first $O_2$ sensor described above. On the basis of this waveform, in step 310 and the following steps in FIG. 6 there are calculated delay times TDR 1 and TDL 1, and the delay time in the second detector means is adjusted suitably through the foregoing delay time adjusting means.

Figures 7A, 7B, 7C:
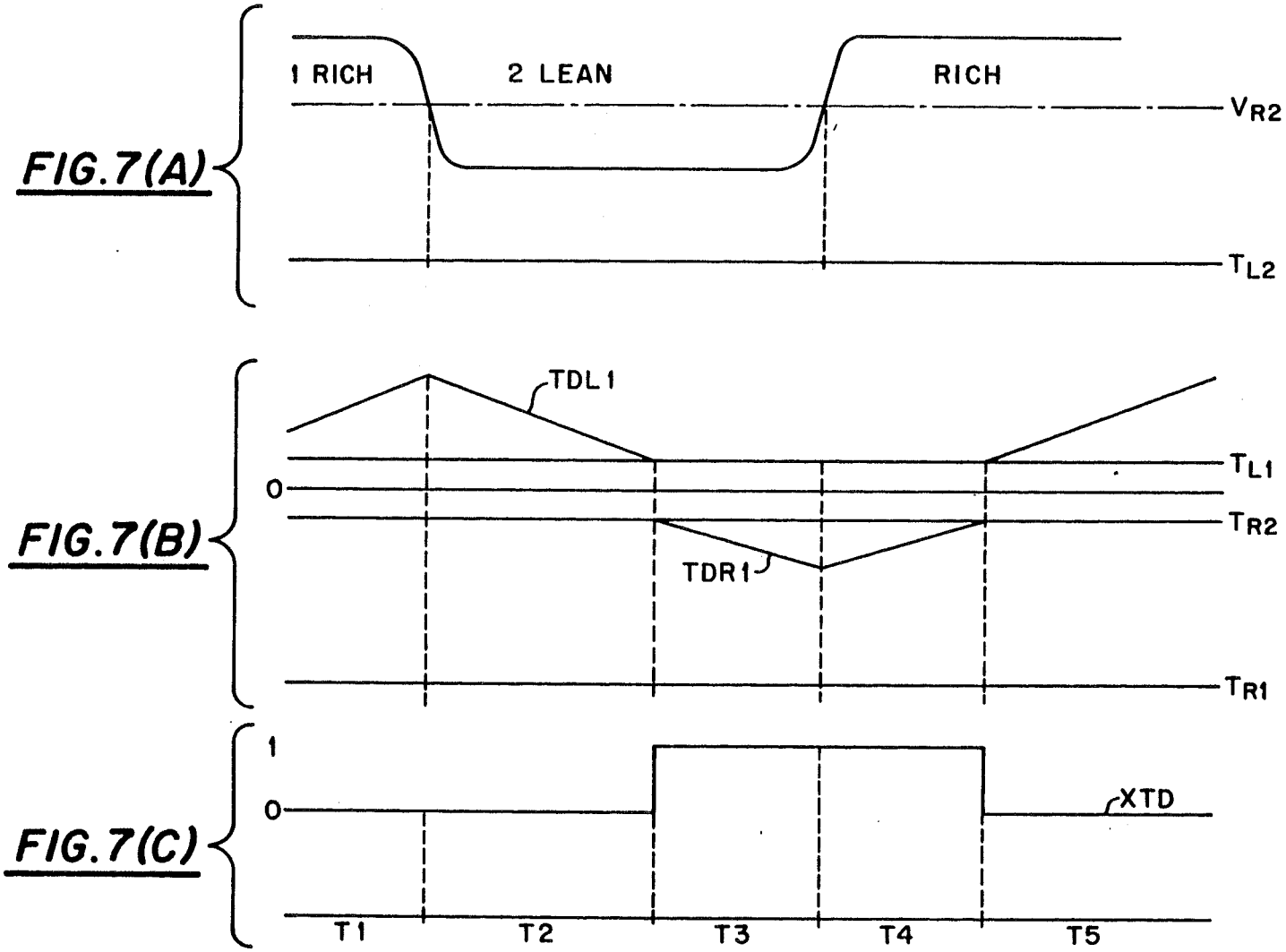
FIG. 7 is a diagram showing in what manner the delay time in the flow of FIG. 4 is adjusted by the flow of FIG. 6.

FIG. 7 is a timing diagram of the delay times TDR 1 and TDL 1 in the flowchart of FIG. 7. When the output voltage V2 of the second $O_2$ sensor 6 varies, as shown in FIG. 7(A), the delay times TDR 1 and TDL 1 are both decreased if the air-fuel ratio is in a lean state (V2 ≦VR2), while in a rich state the delay times TDR 1 and TDL 1 are both increased, as shown in FIG. 7(B). At this time, the rich delay time varies in the range of TR1 to TR2, while the lean delay time TDL1 varies in the range of TL1 to TL2. In the present invention there are used detector means for detecting the deterioration of the first $O_2$ sensor in the air-fuel ratio feedback control described above. How to detect the said deterioration will now be described with reference to FIG. 4. In the same figure, in step 213 after the selection of the air-fuel ratio correction coefficient FAF 1, a judgement is made as to whether the value of a feedback counter CNT corresponding to the first counter in the present invention is 0 or not. If the answer is negative, the processing routine proceeds to step 215, while if the answer is affirmative, then in step 214 a feedback cycle timer CFB which will be described later is cleared, and the processing routine proceeds to step 215. In step 215, the value of CNT is incremented by 1, then in step 216 there is made a judgment as to whether the counter CNT has counted a predetermined value, say, 10, or more. When the said counter, i.e., the second counter in the present invention, has counted feedback ten times consecutively, the processing routine advances to step 217 in which the counter CNT is cleared. Then, in step 218, the value of the feedback cycle timer (CFB) which is incremented at every predetermined cycle, e.g. 1 ms, it is stored in RAMTFT for example and this routine is ended. Also in the case where the value of the counter CNT is smaller than 10 in step 216, this routine is ended.

Figure 8:
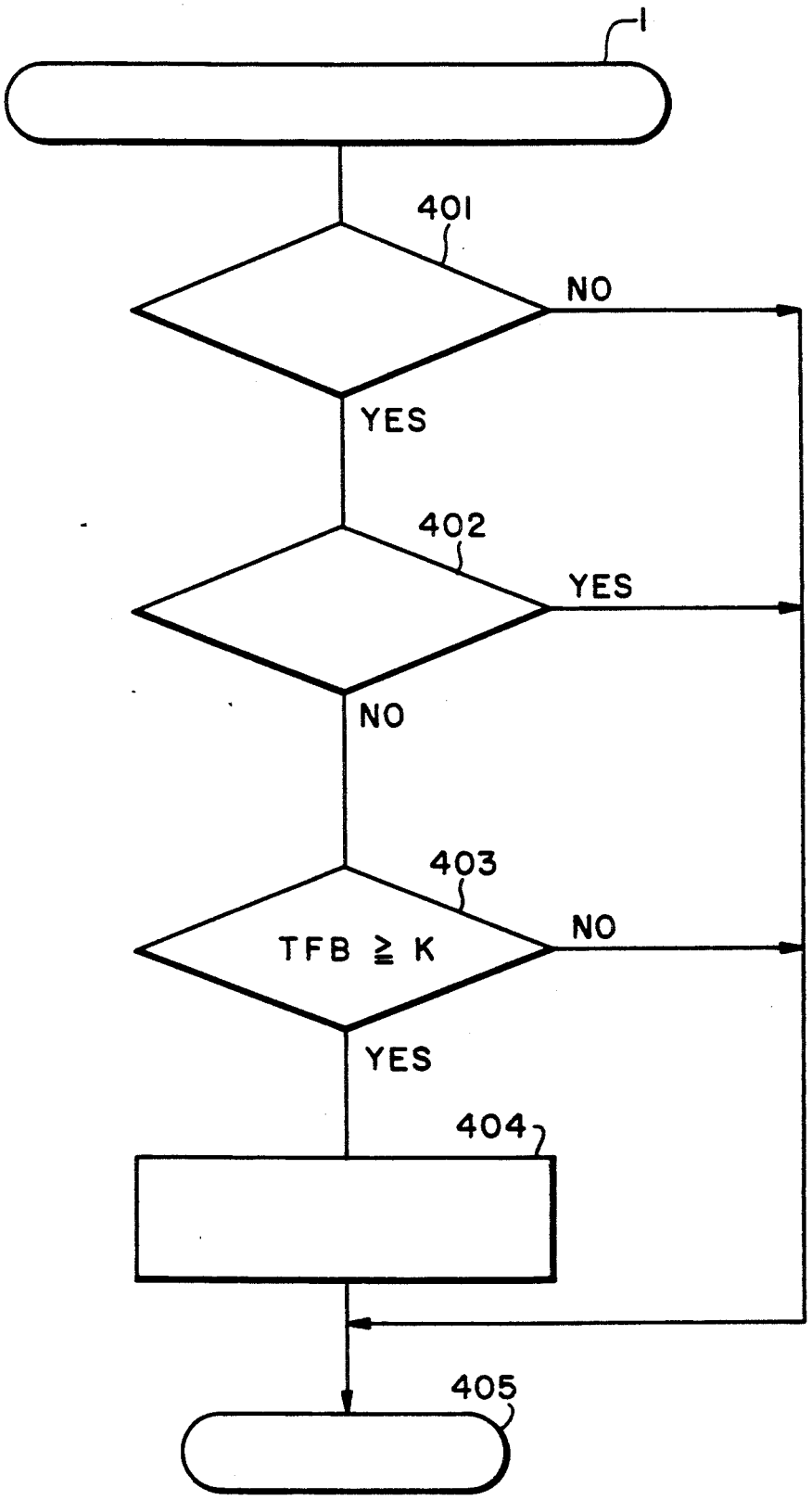
FIG. 8 is a flowchart for detecting the deterioration of an $O_2$ sensor according to the present invention.
Figure 9:
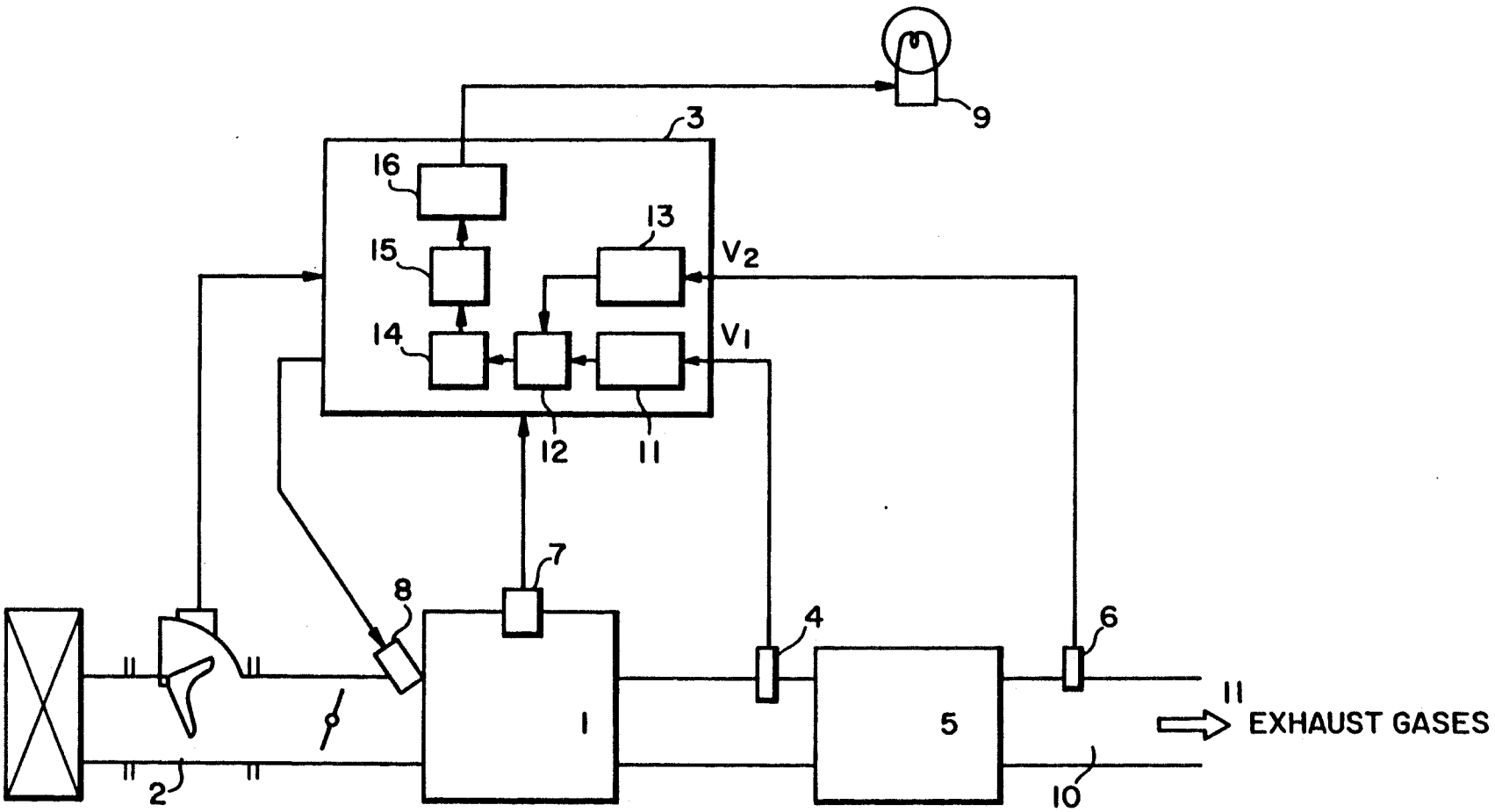
FIG. 9 is a schematic diagram showing an entire construction of the oxygen sensor deterioration detecting apparatus of the invention.

The following description is now provided about detecting the deterioration of the first $O_2$ sensor in the present invention. FIG. 8 illustrates a routine for judging the deterioration of the first $O_2$ sensor 4, which routine is executed at every predetermined time, e.g. every 1 sec. In step 401, a judgement is made as to whether deterioration detecting conditions are satisfied or not, for example whether the water temperature is not lower than a predetermined level or not and whether the driving condition is stable or not. If the conditions are satisfied in step 401, the processing routine advances to step 402, while if the answer is negative, this routine is ended in step 405. In step 402, the alarm lamp 9 has already been ON or not is judged and if the answer is affirmative, the processing routine advances to step 405, while if the answer is negative, the processing routine proceeds to step 403. In step 403, a judgement is made as to whether the cycle (TFB) of consecutive then inversion time-points in the air-fuel ratio feedback using the first $O_2$ sensor 4 is not less than a predetermined value k. If the answer is affirmative, it is judged that the first $O_2$ sensor 4 is deteriorated, and the processing routine proceeds to step 404, in which the alarm lamp is turned on, and this routine is ended. Also in the case where it is judged in step 403 that the first $O_2$ sensor 4 is not deteriorated, this routine is ended. In the present invention, step 402 may be omitted.

According to the present invention, inversion time-points from rich to lean state in the air-fuel ratio feedback signal are detected, and when such inversion time-points have been detected a predetermined number of times consecutively, the number of pulses is measured, then if the measured number of pulses is a predetermined value or more, it is judged that the first $O_2$ sensor is an abnormal conditions. In the present invention, however, time-points reverse to the above inversion may be detected and counted, or a combination of the two is also adoptable. This can be attained, for example, by providing the same counter process as step 213 after step 219 in FIG. 4.

In the present invention, the above judging process is executed by a third detector means.

according to the present invention, as set forth above, even when the response characteristic is deteriorated due to deterioration of the first oxygen sensor, resulting in lowering of the air-fuel ratio feedback frequency, or even when the characteristics of the oxygen sensor deviate from the control center, these phenomena are allowed to appear as changes of the feedback frequency, so that by only controlling the feedback frequency the two types of deteriorations of the oxygen sensor and the deterioration of response characteristic, as well as the deviation of the air-fuel ratio characteristic, can be detected more accurately and easily that in each independent detection.

We claim:

1. In an air-fuel ratio controller of an internal combustion engine including a catalytic converter disposed in an exhaust system of the engine, first and second oxygen sensors disposed on an upstream side and a downstream side, respectively, of the catalytic converter for detecting the concentration of a specific component contained in exhaust gases, and an air-fuel ratio feedback control means which calculates an air-fuel ratio correction coefficient on the basis of output signals provided from the first and second oxygen and corrects a reference amount of fuel to be fed, an apparatus for detecting the deterioration of an oxygen sensor, comprising in said air-fuel ratio feedback control means:

a first detector means for detecting whether an air-fuel ratio feedback signal indicates a rich state or a lean state on the basis of an output of said first oxygen sensor;

a second detector means for adding a predetermined delay time to an output of said first detector means and detecting an air-fuel ratio inversion time-point in the air-fuel ratio feedback signal;

a delay time adjusting means for adjusting the delay time in response to an output of said second oxygen sensor; and a judging means for judging the deterioration of said first oxygen sensor on the basis of a feedback control cycle of the first oxygen sensor after the delay made by said time adjusting means.

2. An apparatus according to claim 1, wherein said delay time adjusting means has a counter for counting time starting from a rich/lean inversion time-point in the output of said first oxygen sensor, and adds the time required for the counted value of said counter to reach a predetermined value, as said delay time, to the output of said first detector means.

3. An apparatus according to claim 2, wherein said delay time adjusting means controls a limit value of the counted value of said counter, using the output of said second oxygen sensor, to adjust said delay time.

4. An apparatus according to claim 1, wherein said judging means judges that said first oxygen sensor is deteriorated when a feedback control frequency of the first oxygen sensor is not higher than that a predetermined value.

5. An apparatus according to claim 4, wherein said predetermined value of said feedback control frequency is set to a value at which the emission of exhaust gases from said engine is not deteriorated.

6. An apparatus according to claim 1, wherein when the output of said second oxygen sensor is lean, said delay time adjusting means decreases the delay time at the time of change of the output of said first oxygen sensor from rich to lean state and increases the delay time at the time of change of the first oxygen sensor output from lean to rich state.

7. An apparatus according to claim 1, wherein when the output of said second oxygen sensor is rich, said delay time adjusting means decreases the delay time at the time of change of the output of said first oxygen sensor from lean to rich state and increases the delay time at the time of change of the first oxygen sensor output from rich to lean state.

8. In an air-fuel ratio controller of an internal combustion engine including a catalytic converter disposed in an exhaust system of the engine, first and second oxygen sensors disposed on an upstream side and a downstream side, respectively, of the catalytic converter for detecting the concentration of a specific component contained in exhaust gases, and an air-fuel ratio feedback control means which calculates an air-fuel ratio correction coefficient on the basis of output signals provided from the first and second oxygen sensors and corrects a reference amount of fuel to be fed, an apparatus for detecting the deterioration of an oxygen sensor, comprising in said air-fuel ratio feedback control means:

a first detector means for detecting whether an air-fuel ratio feedback signal indicates a rich state or a lead state on the basis of an output of said first oxygen sensor;

a second detector means for adding a predetermined delay time to an output of said first detector means and detecting an air-fuel ratio inversion time-point in the air-fuel ratio feedback signal;

a delay time adjusting means for adjusting the delay time in response to an output of said second oxygen sensor; and a first counter detecting an inversion time-point of at least one of rich to lean state and lean to rich state and counting the number of times of occurrence thereof;

a second counter for counting pulses generated until a counted value of said first counter reaches a predetermined value; and a third detector means which judges that said first oxygen sensor is deteriorated when a counted value of said second counter has become the predetermined value or larger and outputs a warning signal.

* * * * *